US007182053B2

(12) United States Patent
Meintschel et al.

(10) Patent No.: US 7,182,053 B2
(45) Date of Patent: Feb. 27, 2007

(54) CAMSHAFT ADJUSTER FOR AN INTERNAL COMBUSTION ENGINE

(75) Inventors: Jens Meintschel, Esslingen (DE); Petra Schulz, Esslingen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 11/303,044

(22) Filed: Dec. 15, 2005

(65) Prior Publication Data

US 2006/0118072 A1 Jun. 8, 2006

Related U.S. Application Data

(63) Continuation-in-part of application No. PCT/EP2004/006155, filed on Jun. 8, 2004.

(30) Foreign Application Priority Data

Jun. 14, 2003 (DE) ..... 103 26 886

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 5,243,935 A 9/1993 Kano et al.
5,247,914 A 9/1993 Imi et al.
2002/0148423 A1* 10/2002 Speier ..... 123/90.17

FOREIGN PATENT DOCUMENTS

| | | |
|---|---|---|
| DE | 43 02 732 | 8/1993 |
| DE | 196 11 365 | 9/1999 |
| DE | 199 08 146 | 8/2000 |
| DE | 199 44 535 | 1/2001 |
| DE | 198 17 319 | 12/2001 |

* cited by examiner

*Primary Examiner*—Thomas Denion
*Assistant Examiner*—Zelalem Eshete
(74) *Attorney, Agent, or Firm*—Klaus J. Bach

(57) ABSTRACT

In a camshaft adjuster including a camshaft driven by a crankshaft of an internal combustion engine via an adjustable drive mounted on the camshaft by a mounting screw having a hollow shank with an axially movable control piston disposed in the hollow shank and an electromagnetic device for operating the control piston, the control piston is axially movable by the electromagnetic device for controlling the supply of oil to, and its release from, the camshaft adjuster for controlling the relative angular position of the crankshaft and the camshaft, the electromagnetic device operated piston also forming an oil pump for providing a supply of oil to the camshaft adjuster.

10 Claims, 5 Drawing Sheets

CAMSHAFT ADJUSTER FOR AN INTERNAL COMBUSTION ENGINE

This is a Continuation-in-Part Application of International Application PCT/EP2004/006155 filed Jun. 8, 2004 and claiming the priority of German Application 103 26 886.3 filed Jun. 14, 2003.

BACKGROUND OF THE INVENTION

The invention relates to a camshaft adjuster for an internal combustion engine the adjuster being mounted to the camshaft by a hollow screw which includes a control piston operable by an electromagnetic operating mechanism.

To lower fuel consumption and untreated emissions as well as increasing the power and torque, gasoline engines are equipped, with camshaft adjusters. The camshaft adjusters vary the phase position of the camshaft in relation to the crankshaft driving the camshaft. At the present time, hydraulic vane-cell adjusters with working chambers are mostly used. Adjustment is carried out by means of the controlled admission of oil from the engine lubricating oil circuit into the chambers of the vane cells via a control valve. The control valve is operated by means of a proportional magnet.

DE 198 17 319 C2 discloses a camshaft adjuster of this type which is disposed in the drive of a camshaft driven by the crankshaft. The camshaft adjuster has an inner body which is rotationally fixed with respect to the camshaft. A central tension screw extends through the inner body, which is engaged thereby axially with the camshaft. An outer body is rotatable with respect to the inner body and is driven by the crankshaft. Between the inner body and the outer body, a reception space is provided for hydraulic actuating fluid for rotating the outer body with respect to the inner body. The actuating fluid admission is controlled by a control device with a multiple-way valve in the form of a control slide, the valve being integrated into the tension screw which forms an axial housing for the axially displaceable control slide. The control slide is connected to the armature of an electromagnetic actuating drive which is arranged fixedly with respect to the housing and which comprises an actuating magnet.

For the general technical background, reference is also made to DE 196 11 365 C2, DE 196 54 926 C2 and DE 199 44 535 C1.

It is the object of the present invention to provide a camshaft adjuster which, independently of the lubricating oil pressure of the internal combustion engine, allows high actuating speeds for varying the phase position of the camshaft.

SUMMARY OF THE INVENTION

In a camshaft adjuster including a camshaft driven by a crankshaft of an internal combustion engine via an adjustable drive mounted on the camshaft by a mounting screw having a hollow shank with an axially movable control piston disposed in the hollow shank and an electromagnetic device for operating the control piston, the control piston is axially movable by the electromagnetic device for controlling the supply of oil to, and its release from, the camshaft adjuster for controlling the relative angular position of the crankshaft and the camshaft, the electromagnetic device operated piston also forming an oil pump for providing a supply of oil to the camshaft adjuster.

An essential advantage of the invention is that the control piston, hitherto responsible only for controlling the oil supply of the camshaft adjuster, is now used additionally for pumping. That is to say, the adjuster thus possesses its own oil pump and is consequently independent of the engine oil pressure. Adjustment is possible at any time, and/or at increased adjusting speed.

Advantageously, a camshaft adjuster on the basis of the vane-wheel principle is employed. In order to permit a wide adjustment range of the adjuster, only three vanes are provided on the wheels of the adjuster. In order to actuate the control piston, two individual electromagnets are provided, which, according to the principle of a single-mass spring oscillator, move the control piston forward and backward by means of reciprocal current application via an armature, the control piston being held in the middle position by means of two springs when the magnets are de-energized. During operation, after the release of the armature from the first magnet, the control piston rapidly moves toward the opposite side as a result of the energy stored in the springs. Energization of the second magnet overcomes the energy losses due to friction and due to the useful work of a pump.

Advantageously, with an appropriate design the helical spring makes it possible to bring the adjuster into any desired intermediate position (emergency running position) when the engine oil is not pressurized. As compared with the electrical camshaft adjuster, considerable energy benefits are obtained in this case. In the known arrangement using a summing gear, part of the restoring moment is always supported on the servomotor and, even in the case of a constant phase position, requires a continuous application of a force to the latter. Since the moment of the restoring spring must higher than the load moment of the camshaft, relatively powerful electric motors are required. The hydraulic actuator operates counter to the spring during the adjusting operation only. In the case of a constant phase position, it is locked and has only to make up the leakage losses.

The invention will become more readily apparent from the following description of an exemplary embodiment thereof with reference to the accompanying drawings:

DESCRIPTION OF A PARTICULAR EMBODIMENT

Figure 1:
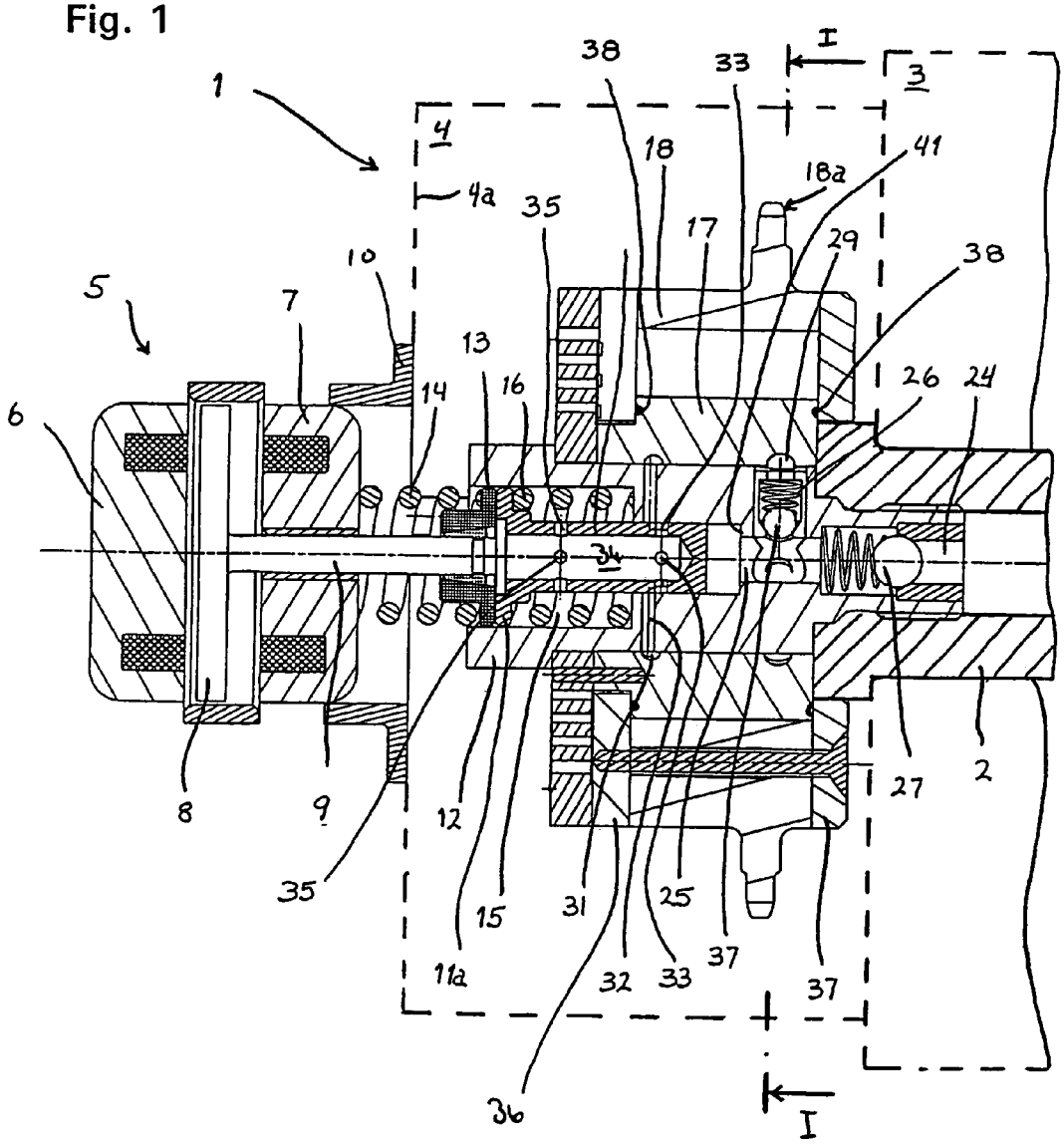
FIG. 1 shows a longitudinal section through a camshaft adjuster according to the invention which is arranged in the extension of the camshaft of an internal combustion engine and is received by a control housing, the camshaft adjuster having a control piston which is acted upon by an electromagnetic device by means of an armature.

The camshaft adjuster according to FIGS. 1 to 7 is designated generally by 1 and is illustrated as being assigned to a camshaft 2 of an internal combustion engine which is indicated merely diagrammatically here and is designated by the reference numeral 3. At the end face of the internal combustion engine at the illustrated end of the camshaft 2, a control housing 4 is provided, which is indicated essentially merely diagrammatically. The control housing 4 includes an electromagnetic device 5 in the axial extension of the camshaft 2, which device is assigned to the camshaft adjuster 1. It includes a first electromagnet 6 and a second electromagnet 7 and also an armature 8 arranged displaceably between the two electromagnets 6, 7 and having an armature tappet 9. It is screwed from outside, via a carrier 10, onto the control housing cover 4*a* mounted on the internal combustion engine 3.

The electromagnetic device 5 acts via the armature tappet 9 of the armature 8 on a control piston 11 which is integrated into a central screw 12 in the form of a tension screw, via which the camshaft adjuster 1 is screwed onto the camshaft 2, together with the control piston 11 and the camshaft adjuster 1 and also the electromagnetic device 5. The armature tappet 9 has a spring support plate 13 at its end opposite the armature 8. A first compression spring 14 is arranged between the spring support plate 13 and the second electromagnet 7 of the electromagnetic device 5. The control piston 11 is disposed in a bore 15 in the tension screw 12 and which has a widened open end adjacent the electrical device 5 and, together with the control piston 11, forms a spring space 15. In this spring space 15, a second compression spring 16 is arranged, which is supported at one end on the tension screw 12 and at its other end on a collar 11*a* integrally formed on the control piston 11. Without the springs 14, 16, the control piston 11 is moved solely by means of the two magnets 6, 7.

The camshaft adjuster 1 comprises an inner body 17 and an outer body 18, which are rotatable in relation to one another for adjustment. The inner body 17 is seated, braced axially against the camshaft 2 on the tension screw 12. The outer body 18 has on its outer circumference toothings 18*a*, via which the camshaft 2 is driven by the crankshaft, not illustrated here, of the merely indicated internal combustion engine 3 in a fixed assignment with respect to direction of rotation and to rotational speed. The chain drive indicated and referred to here may, of course, also be replaced by other drive connections, such as, for example, toothed belt drives or else gearwheel drives.

Figure 2:
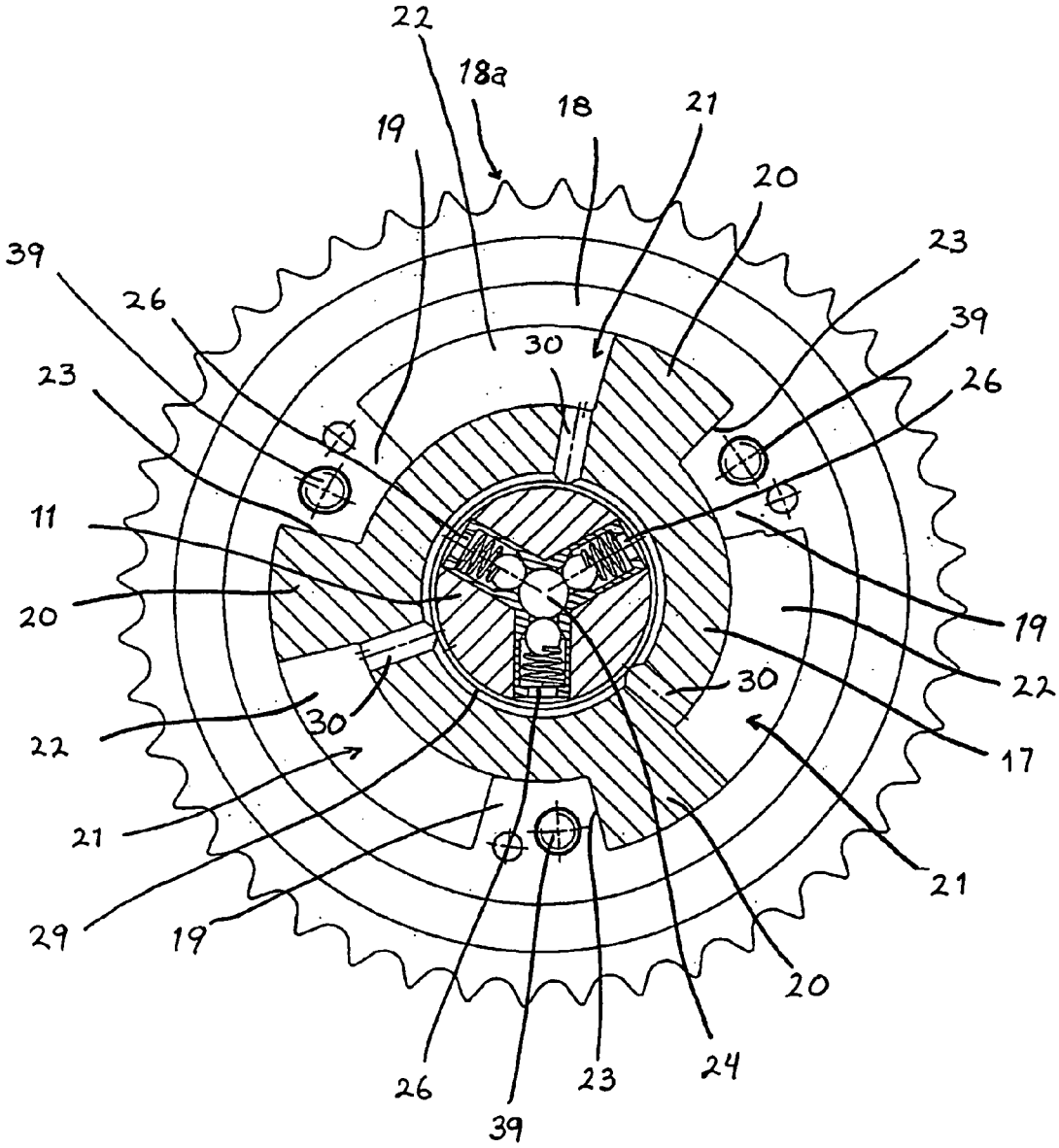
FIG. 2 is a sectional view taken along line I—I of FIG. 1 in a simplified illustration.

According to FIG. 2, the outer body 18 has, distributed over its circumference, actuating means projecting radially inward and taking the form of piston vanes 19, to which counter-vanes 20 are assigned as actuating means on the inner body 17, in each case two counter-vanes 20 delimiting a reception space 21 in the form of a sector of a ring, in which a piston vane 19 of the outer body 18 is disposed. The outer body 18 forms with its piston vanes 19, virtually a vane rotor adjustable with respect to the inner body 17 over an angular range which is limited by the counter vanes 20 of a reception space 21.

Within the respective reception space 21, piston vanes 19 and counter-vanes 20 in each case delimit two working chambers 22 and 23 to which hydraulic fluid can be supplied under the control of the control piston 11. In the illustrated position of the piston vane 19 and counter-vane 20 the working chamber 23 consists of a gap.

Pressure medium is supplied to the respective working chamber 22, 23 from the camshaft 2. From the camshaft 2, an axial duct 24 in the tension screw 12 extends to a compression chamber 25 in the tension screw 12 and from there to radial bores 26 in the tension screw 12. A non-return valve 27, 28 is disposed in each of the axial duct 24 and in the radial bores 26, the non-return valve of the axial duct 24 operating as an intake valve 27 and the non-return valves of the radial bores 26 operating as pumping valves 28. As can be seen in FIG. 2, the radial bores 26 in the tension screw 12 extend into an annular space 29 formed between the tension screw 12 and inner body 17. The pressure medium passes via the annular space 29 into the respective working chamber 22, 23 by way of passages 30 in the inner body 17.

As can be seen in FIG. 1, the pressure medium can be discharged from the respective working chamber 22, 23 via an annular duct 31 which is arranged between the tension screw 12 and the inner body 17. Proceeding from this, radial passages 32 arranged in the tension screw 12 lead to at least one oil inlet 33 in the control piston 11, from where the pressure medium passes via a cavity 34 in the control piston 11 to an oil outlet 35 in the control piston 11.

The working chambers 22, 23 in the reception spaces 21 are closed laterally by means of annular covers 36, 37 which, when the inner body 17 and outer body 18 are designed as planar disks with end faces perpendicular to the axis of the camshaft 2, are likewise planar. In this case sealing may be provided radially on the outside by means of annular seals 38 between the inner body 17 and the annular covers 37, 38. However, with correspondingly fine machining, a separate seal may be omitted if the working pressures are low. The annular covers 36, 37 are held via axial tension screws 39 in engagement with the end faces of the inner body 17 and the outer body 18. A helical spring 40 is arranged in front of the annular cover 36 facing the electromagnetic device 5. The helical spring 40 is fastened on the inside to the inner body 17 and on the outside to the annular cover 36 and can thus rotate the camshaft adjuster 1 back into an initial or emergency running position in a pressureless state.

The following FIGS. 3 to 7 show, in a simplified illustration of the camshaft adjuster 1, only the tension screw 12 which is arranged in the inner body 17 and which receives the control piston 11 which is acted upon via the electromagnetic unit 5 and the compression springs 14, 16, only the compression spring 16 being illustrated.

Figure 3:
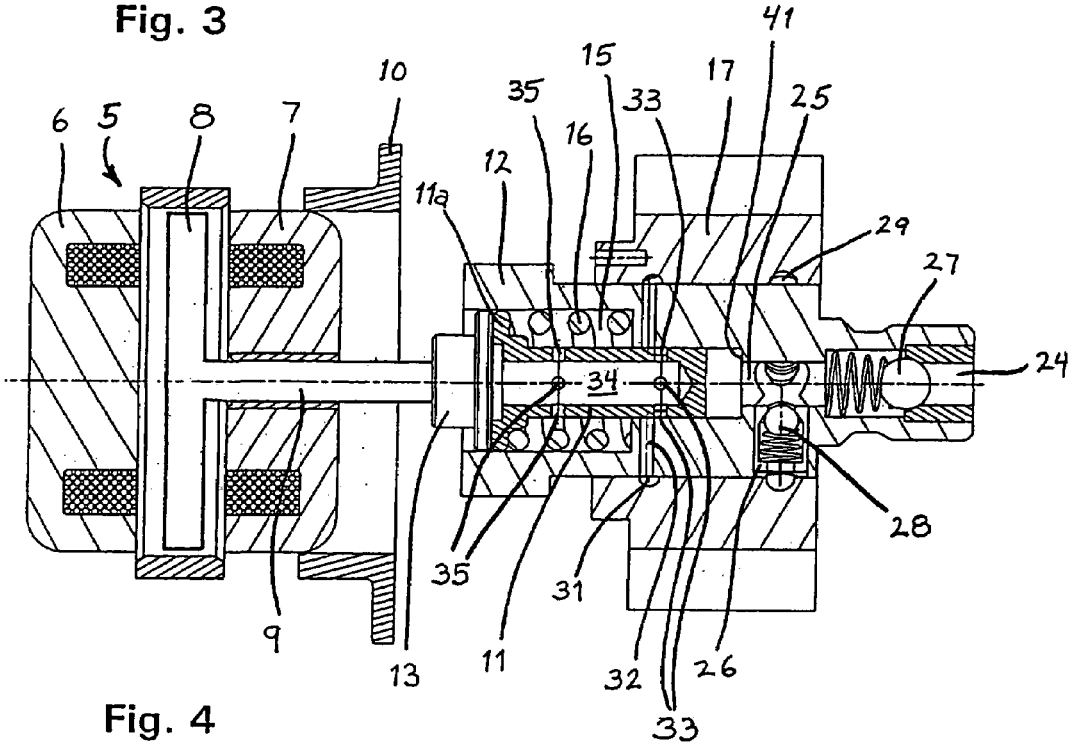
FIG. 3 shows the camshaft adjuster, illustrated in simplified form, in the neutral position, the armature and the control piston being held in the center position by springs.

FIG. 3 shows the position of the camshaft adjuster 1 which corresponds to the starting position of the internal combustion engine. In the deenergized state, the armature 8 and control piston 11 are in the middle position due to the force of the two compression springs 14, 16, all the passages which carry pressure medium being closed.

Figure 4:
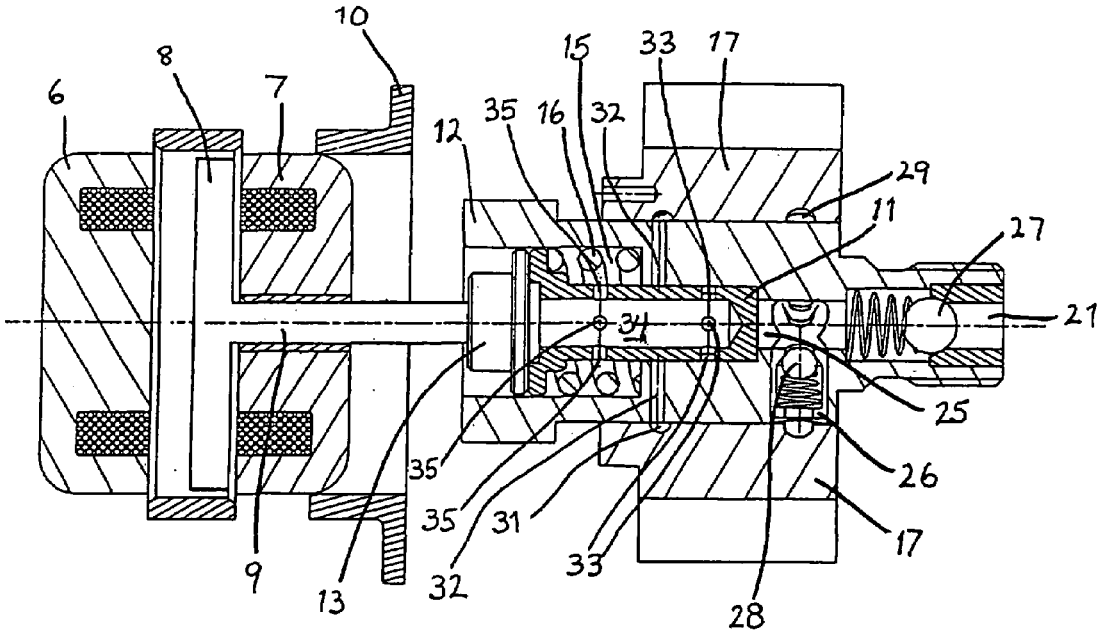
FIG. 4 shows the camshaft adjuster in a holding position or in the position after start-up of the system, the armature bearing against a magnet and the control piston bearing against a stop of the central screw of the camshaft adjuster.

To start up the system, the armature 8 is first brought, according to FIG. 4, into an end position or into a holding state, wherein the armature 8 abuts the second magnet 7 of the electromagnetic device 5 and the control piston 11 bears against a stop 41 of the tension screw 12. The armature 8 can be brought into this end position by a start-up oscillation as it is known from electromagnetic engine inlet and outlet valve controls, in that current is supplied to the two magnets 6, 7 alternately at the characteristic frequency of the system, such that the armature 8 begins to oscillate with the aid of the compression springs 14, 16 and is then captured and held by the respective magnet 7.

According to the invention, the control piston 11 may additionally be used as an oil pump for controlling the oil supply, which means that the central screw 12 forms at the same time the pumping and control device for the camshaft adjuster 1.

Figure 5:
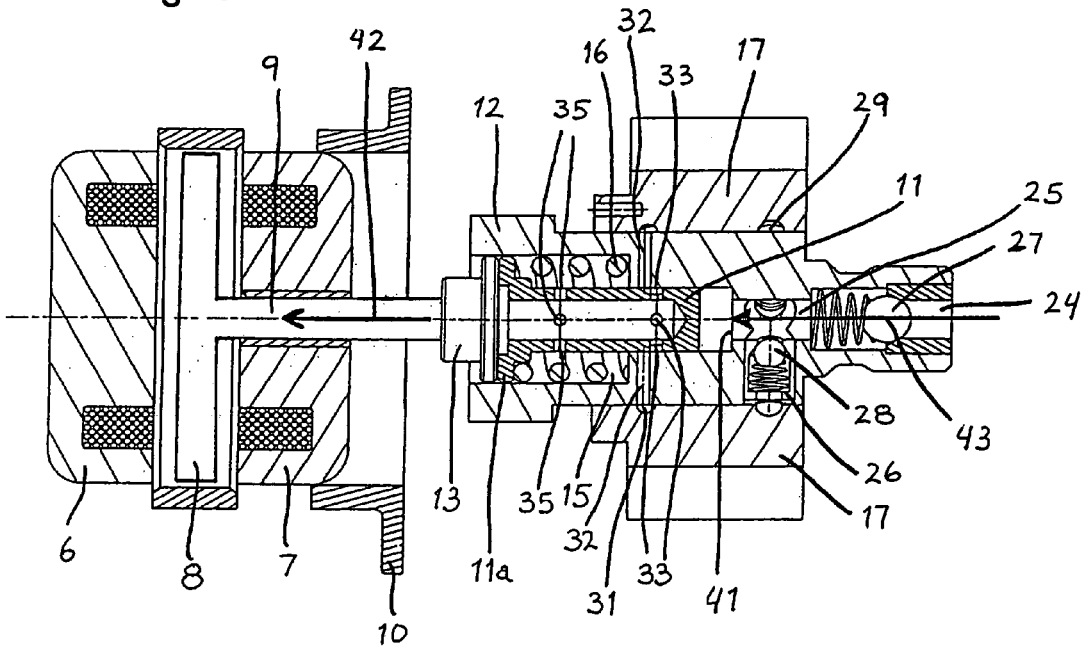
FIG. 5 shows the camshaft adjuster during the intake operation, when the control piston is accelerated in the direction toward the other magnet by the force of one of the compression springs.

During the intake step according to FIG. 5, when the armature 8 is released from the second magnet 7, the armature 8 is accelerated in the direction 42 of the first magnet 6 by the spring force of the compression spring 14, with the result that the control piston 11 is moved away from the stop 41 of the tension screw 12. By means of the intake valve 27 arranged in the axial duct 24 of the central screw 12, pressure medium, engine oil in the present case, is sucked out of the camshaft 2 into the compression chamber 25 (pressure medium flow 43). The engine oil pressure assists this operation, so that, after build up of a specific pressure, work is no longer required for this purpose.

Figure 6:
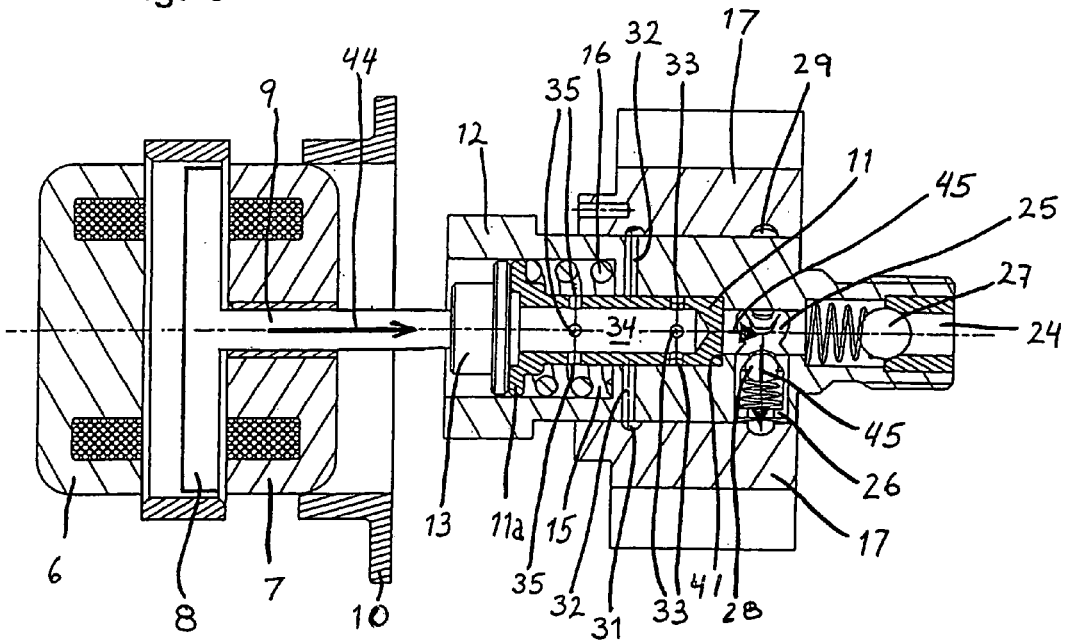
FIG. 6 shows a camshaft adjuster during the pumping or filling operation when the armature and control piston move in the opposite direction to the intake direction.

During the filling operation according to FIG. 6, the armature 8 moves from the magnet 6 in the direction 44 of the magnet 7 and the control piston 11 moves in the toward the stop 41. The intake valve 27 is closed by means of a spring force. The pressure medium presses onto the pumping valves 28 arranged radially in the tension screw 12 (pressure medium flow 45) and passes via the annular space 29 running around in the inner bore of the inner body 17 and via radial bores 30 in the inner body 17, according to FIG. 2, into the respective working chamber 22 and 23, so that an adjusting movement of the camshaft adjuster 1 takes place. The pressure medium quantity of one pumping stroke corresponds to the required adjusting accuracy. Advantageously, at least one of the magnets 6, 7 is optimized in terms of better remote actuation and movement capability (characteristic curve influencing, KLB magnet). For this purpose, on a pot magnet, noses reducing the air gap between armature and yoke are formed on the outside.

When a specific oil pressure is reached in the engine circuit is, pumping strokes are no longer required in order to fill the working chambers 22, 23 of the camshaft adjuster 1. The control piston 11 is in this case brought into the neutral position according to FIG. 3, and the oil, after pressing open the intake valve 27 and pumping valve 28 passes automatically into the working chambers 22, 23. To interrupt the filling operation, the control piston 11 is moved to the right again, until the armature 8 abuts the magnet 7.

Figure 7:
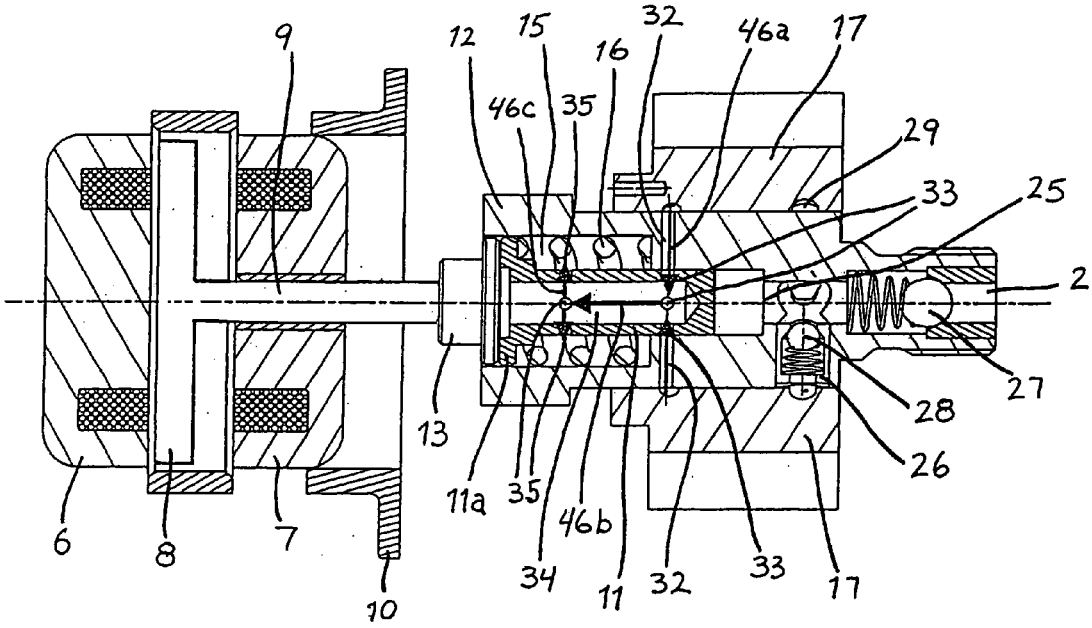
FIG. 7 shows the camshaft adjuster during the emptying operation, the armature bearing against the first magnet.

During the emptying operation according to FIG. 7, the control piston 11 is in the extended state, the armature 8 being located at least in the vicinity of the magnet 6. In this position of the control piston 11, the oil flows out of the working chambers 22, 23 via the annular duct 31 into the radial passages 32. From there, the oil passes via the at least one oil inlet 33 into the cavity 34 of the control piston 11 and leaves the control piston 11 via the oil outlet 35 (pressure medium flow 46*a*, 46*b*, 46*c*).

In the holding state according to FIG. 4, the armature 8 and control piston 11 are located at the limit stop, that is to say the armature 8 abuts the magnet 7 and the control piston 11 abuts the stop 41. Since no oil is released in this neutral position of the armature 8 and control piston 11, the phase position is maintained. However, before a renewed adjusting operation is initiated, the armature 8 must then be brought into an end position, preferably to abut the magnet 7 (if appropriate, by energy-intensive start-up oscillation).

In order to minimize leakage losses from the working chambers 22, 23 of the camshaft adjuster 1 and to avoid a resetting of the phase position, preferably the annular seals 38 between the inner body 17 and the annular covers 36, 37 and spring-loaded sealing strips at the ends of the countervanes 20 of the inner body 17 must be provided.

Moreover, a known locking bolt may be used, which, in the pressureless state, is moved into a latching recess in the inner body 17 by means of a spring and thus prevents a rotation of the inner body 17. The bolt can again be released by oil pressure.

To reduce the overall axial length of the engine, it may be necessary to mount the electromagnetic device 5 and the pumping and control device elsewhere (for example, below the chain gear).

The invention claimed is:

1. A camshaft adjuster (1) including a camshaft driven by a crankshaft of an internal combustion engine, an adjustable drive mounted on the camshaft by a mounting screw having a hollow screw shank (12), an axially displaceable control piston (11) disposed in said hollow screw shank (12) for controlling the supply of oil to, and from, the camshaft adjuster (1), an electromagnetic device (5) disposed adjacent the control piston (11) for operating said control piston (11), said camshaft adjuster (1) including transmission parts (17, 18) which are rotatable in relation to one another for adjustment of the angular position of the camshaft relative to the crankshaft, said control piston (11) being axially movable by said electromagnetic device so as to additionally act as an oil pump for providing an oil supply to the camshaft adjuster.

2. A camshaft adjuster as claimed in claim 1, wherein the electromagnetic device (5) has an armature (8) which is arranged displaceably between two electromagnets (6, 7) said the armature having a tappet (9) for actuating the control piston (11).

3. A camshaft adjuster as claimed in claim 1, wherein, in addition to the electromagnetic device (5), a spring system (14, 16) is provided for acting upon the control piston (11).

4. A camshaft adjuster as claimed in claim 1, wherein the tension screw (12) includes an axial duct (24), which extends to a sealed chamber (25) with radial bores (26).

5. A camshaft adjuster as claimed in claim 4, wherein non-return valves (27, 28) are arranged both in the axial duct (24) and in the radial bores (26).

6. A camshaft adjuster as claimed in claim 5, wherein the radial bores (26) extend to an annular space (29) which is connected to working chambers (22, 23) of the camshaft adjuster (1) via radial ducts (30).

7. A camshaft adjuster as claimed in claim 6, wherein the working chambers (22, 23) are connected via an annular duct (31) to radial bores (32) which are in communication, via at least one oil inlet (33), with a cavity (34) which is formed in the control piston (11) and which has at least one oil outlet (35).

8. A camshaft adjuster as claimed in claim 1, wherein the camshaft adjuster (1) has a helical spring (40) which is fastened to the inner body (17).

9. A camshaft adjuster as claimed in claim 1, wherein the screw shank (12) contains at the same time the oil pump device and the control device for the camshaft adjuster (1).

10. The camshaft adjuster as claimed in claim 1, wherein the camshaft adjuster (1) is a hydraulic vane-wheel adjuster.

* * * * *